US005678532A

United States Patent [19]

Wu

[11] Patent Number: 5,678,532

[45] Date of Patent: Oct. 21, 1997

[54] GUARD DEVICE FOR SMOKE EXHAUSTER

[76] Inventor: Min-Wei Wu, Suite 2, 7F, No. 95-8, Chang Ping Road, Sec. 1, Taichung, Taiwan

[21] Appl. No.: 699,803

[22] Filed: Aug. 19, 1996

Related U.S. Application Data

[63] Continuation-in-part of Ser. No. 570,492, Dec. 11, 1995, Pat. No. 5,582,160.

[51] Int. Cl.[6] ..... F24C 15/20

[52] U.S. Cl. ..... 126/299 R; 126/299 D; 126/299 F; 126/299 C

[58] Field of Search ..... 126/299 R, 300, 126/299 C, 299 D, 299 E, 299 F

[56] References Cited

U.S. PATENT DOCUMENTS

| | | | |
|---|---|---|---|
| 3,527,200 | 9/1970 | Baltz | 126/42 |
| 3,556,624 | 1/1971 | Baltz et al. | 126/42 X |
| 4,133,300 | 1/1979 | Burton, Jr. et al. | 126/299 D |
| 4,856,493 | 8/1989 | Fleming et al. | 126/299 D X |
| 5,027,790 | 7/1991 | Chern | 126/299 D X |
| 5,582,160 | 12/1996 | Wu | 126/299 C |
| 5,615,667 | 4/1997 | Seeley et al. | 126/42 |

*Primary Examiner*—Larry Jones

[57] ABSTRACT

A guard device for protecting the front panel of a smoke exhauster is provided. The device comprises generally a rectangular guard plate slidingly held in a pair of securing appendages which are respectively secured to the ends of the front panel and each has a sliding space, a fillet and a hook member therein. So that the guard plate is snap fitted and repeatedly slides about the sliding space in order to protect the front panel of the smoke exhauster from contaminated with oil and grime.

5 Claims, 5 Drawing Sheets

GUARD DEVICE FOR SMOKE EXHAUSTER

BACKGROUND OF THE INVENTION

This continuation-in-part application discloses and claims subject matter disclosed in my earlier filed pending application, Ser. No. 08/570,492, filed Dec. 11, 1995, now U.S. Pat. No. 5,582,160, Feb. 10, 1996.

The present invention relates to smoke exhauster, and more particularly to a guard device which covers the front panel of a smoke exhauster for protecting the switch buttons of the panel from contaminated with oil and grime.

Typical smoke exhauster has generally an enclosure, a hood plate including a pair of apertures formed in the center for receiving the suction fans which are secured under the enclosure of the exhauster and a panel at the front portion of the enclosure on which a plurality of switch buttons which are arranged to switch on and off the suction fans to run to exhaust the smoking out of a kitchen via a vent on the top of the exhauster.

Normally, the smoke exhauster locates over a stove or cooking ranges in a kitchen and has a releasable structure so that both the fan housings and the hood plate are easily and quickly assembled or disassembled in order to facilitate frequent cleaning the oil and grime accommulated thereon. However, the oil and grime contaminated on the front panel are difficult to remove because the switch buttons especially the touch-to-run type, are sensitive to the detergent cleaners which etchs the surface of the button and infiltrates into the clearances therebetween that may mar the electronics in the panel. Thus, layers of oil and grime accommulated on the panel as the time goes by and the switch buttons may become inactive and unable if there is no corrective measure that has been taken to rectify this shortcomings.

SUMMARY OF THE PRESENT INVENTION

The present invention has a main object to provide a guard device for smoke exhauster which can effectively protect the panel of the smoke exhauster from contaminated with oil and grime in order to keep the switch buttons on the panel to be active and reliable.

Another object of the present invention is to provide a guard device for smoke exhauster which has a simplified and adroit structure which is readily applied to accommodate with frequent operation.

Accordingly, the guard device of the present invention comprises generally a guard plate and a pair of securing appendages which are symmetrically arranged and mounted to the lateral ends of the front panel of the exhauster and each has a longitudinal slide and transverse fillet therein for facilitating the ends of the guard plate to be held in and slid thereabout. The guard plate usually covers on the panel and is easily slid out when operates the switch button.

The present invention will become more fully understood by reference to the following detailed description thereof when read in conjunction with the attached drawings.

DETAILED DESCRIPTION OF THE PREFERRED EMBODIMENT

Figure 1:
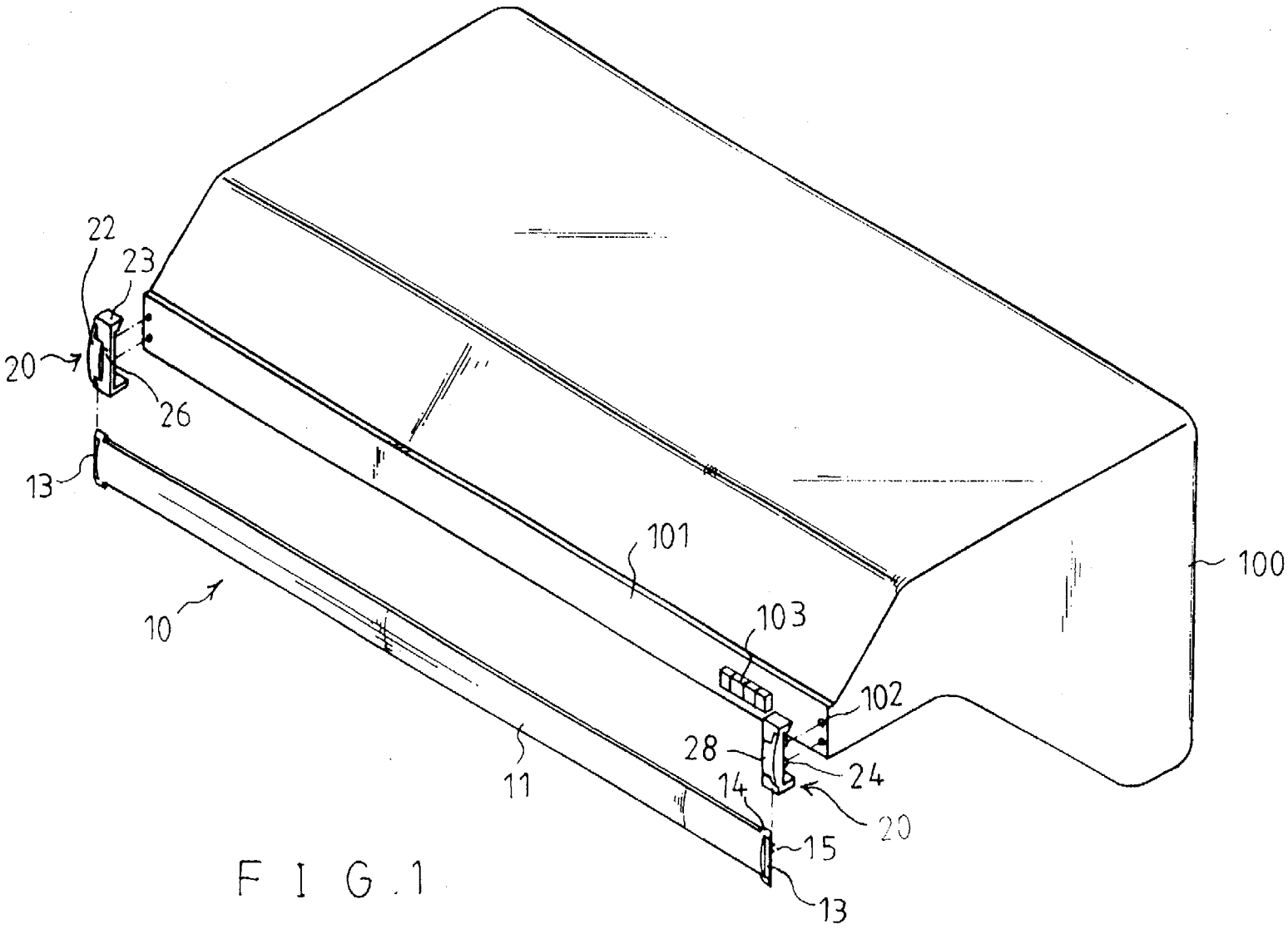
FIG. 1 is a perspective view to show the preferred embodiment of the guard device according to the present invention.
Figure 2:
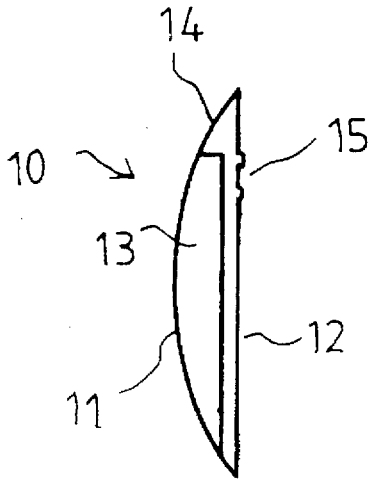
FIG. 2 is a sectional view of the guard plate.
Figure 3:
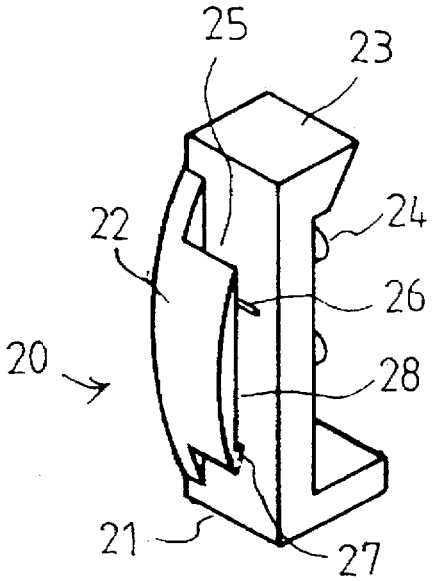
FIG. 3 is a perspective view of a enlarged securing appendage.

With reference to FIGS. 1, 2 and 3 of the drawings, the guard device of the present invention comprises a generally rectangular guard plate 10 and a pair of securing appendages 20. The guard plate 10 has an arched front surface 11, a planar rear surface 12 and a flat portion 13 at each end. Each flat portion 13 has a first hook member 14 at the upper end which has a roughly right angular section toward forward and an arched surface joined with the arched surface 11 of the plate 10 and a pair of fillets 15 transversely and parallel extended spaced apart on the back side of it's upper portion.

The securing appendages 20 of symmetrical arrangement each has a rectangular body 21, a protrudent portion 22 at front side, a pair of transverse flanges 23 rearwardly extended from two ends respectively for gripping the narrower portion of the front panel, a pair of retaining rods 24 perpendicularly projected outward and spaced apart from the inward surface of the rectangular body 21 and a transverse fillet 26 projected from the outward surface which is formed in cooperation with the pair of fillets 15 of the guard plate 10. The protrudent portion 22 is in form of a roughly T-shaped connected to a lateral a side and abutting the most forward surface of the rectangular body 21 and defines a sliding space 25 therebetween with a second hook member 27 inwardly projected from the transverse lower edge of the T-shaped protrudent portion 22.

The rectangular body 21 of the securing appendage 20 has a length equal to the width of the front panel 101 of the smoke exhauster 100, and the retaining rods is made in registry with holes 102 adjacent the lateral ends of the panel 101. So that the securing appendages 20 fixedly and respectively secure to the two ends of the panel 101 (as shown in FIGS. 1 and 4).

The protrudent portion 22 of the securing appendages 20 has an arched front surface in configuration with the arched front surface 11 of the guard plate 10 and the sliding spaces 25 of the two securing appendages 20 have their openings 28 oppositely toward inward so as to oppose each other that permits two ends of the guard plate 10 to slid in.

Figure 4:
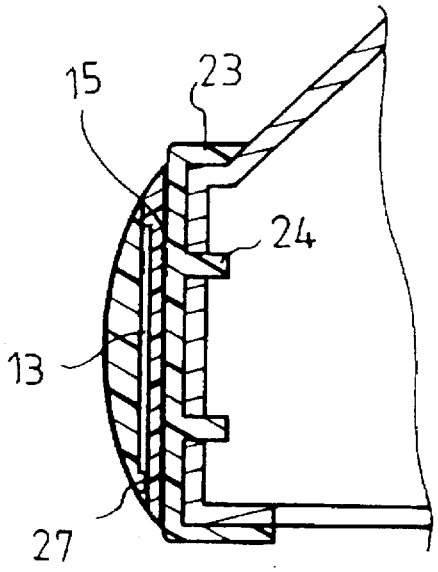
FIG. 4 is a sectional view illustrating the guard device of the present invention being mounted to the front panel of an exhauster.
Figure 5:
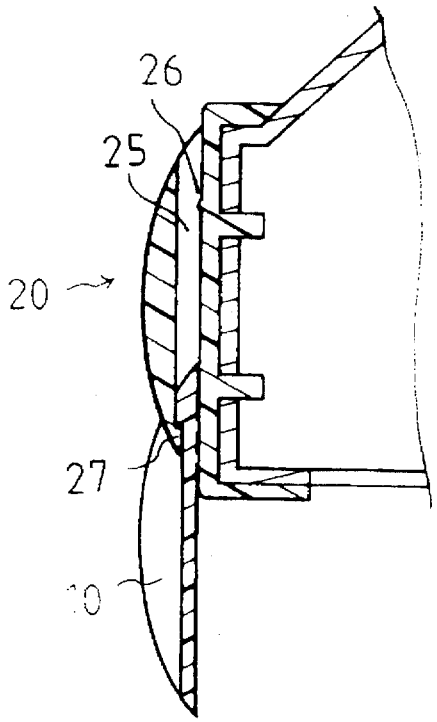
FIG. 5 is a sectional view indicating that the guard plate slides downward and is suspended by the securing appendage therefrom.

Referring to FIGS. 4 and 5, when the guard plate 10 slids in the pair of the securing appendages 20, the fillets 15 at it's two ends will engage with the fillet 26 of the securing appendages 20 in snap fitting so that the plate 10 is stably held in the appendages and completely covers the top of the front panel 101. When the smoke exhauster is in use, slightly press the guard plate 10 so that the plate 10 slides downward and is suspended therefrom the second hook member 27 which has an upper surface mating with the lower surface of the first hook member 14 of the plate 10. After that the exhauster is operably by applying the switch buttons 103, then press the plate 10 upward so as to snap fit again the plate 10 in place into the sliding space 25. Repeated operation of the guard plate 10 as recited above would be necessary and easily to do so as to keep the guard plate 10 that normally covers the front panel 101 in order to protect the panel 101 from contaminated with oil and grime.

Figure 6:
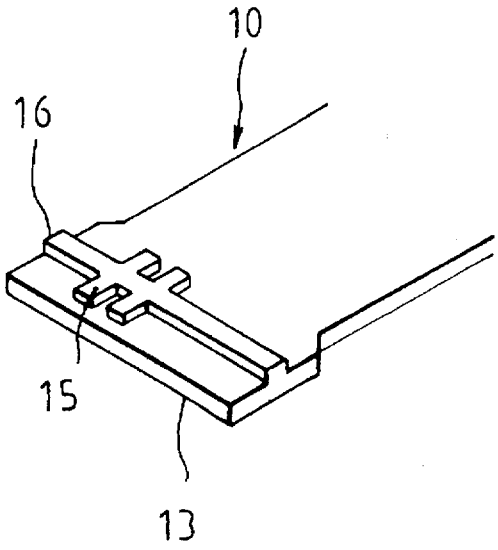
FIG. 6 is a perspective view to show an alternative embodiment of the guard plate of the present invention.
Figure 7:
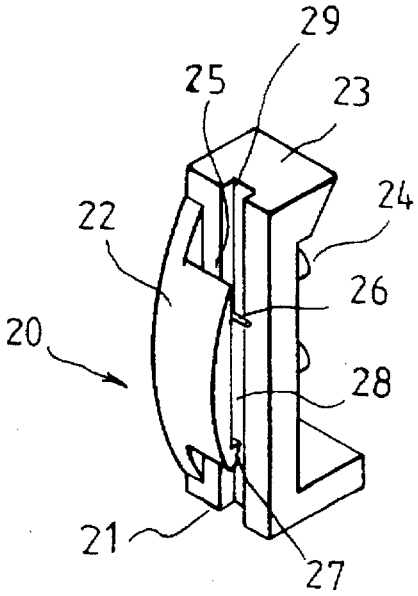
FIG. 7 is a perspective view to show an alternative embodiment of the appendages of the present invention.

Referring to FIGS. 6 and 7, for the obviation of the guard plate 10 from a horizontal oscillation and the prevention of the flat portions 13 of the plate 10 from disengagement with the appendages 20, as alternative embodiment is shown. In this embodiment, the general function and structure of the guard device is mostly similar to that illustrated in FIGS. 1, 2 and 3 and the above discussion is equally applicable to this embodiment in the most instances.

A rectangular protrusion 16 is provided which extends vertically along a center of the back side of each plate portion 13 of the guard plate 10, perpendicular to the longitudinal axis of the plate 10 and the pair of fillets 15. In cooperation with the protrusion 16, a rectangular guide slot 29 is provided and extends vertically along a center of the front surface of the rectangular body 21 of each of the appendages 20 and across the transverse fillet 16. Based on this improvement, when the guard plate 10 slides about the appendages 20 along the guide slots 29 will prevent the plate 10 from any horizontal oscillation or disengagement with the appendages 20.

Figure 8:
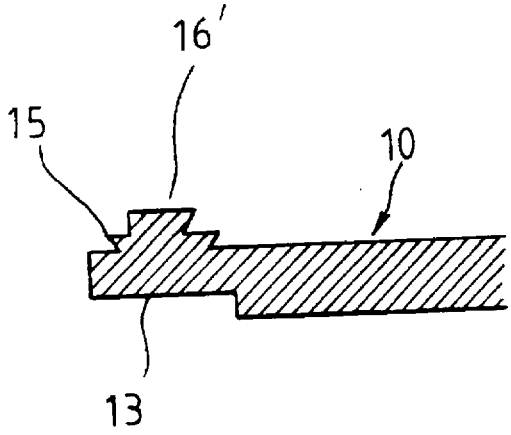
FIG. 8 is a sectional view to show another alternative embodiment of the guard plate of the present invention.
Figure 9:
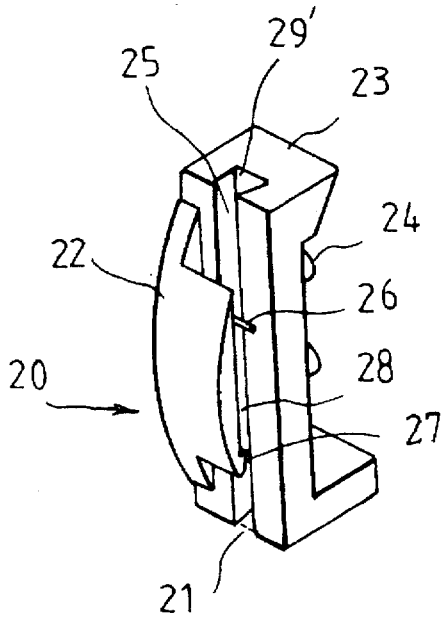
FIG. 9 is a perspective view to show another alternative embodiment of the appendages of the present invention.

Referring to FIGS. 8 and 9 which shows another embodiment of a beveled rectangular protrusion 16' vertically extended along the center of the back side of each flat portion 13 of the guard plate 10 and a beveled rectangular guide slot 29' vertically extended along the center of the front surface of the rectangular body 21 of the appendages 20. This beveled configuration of the rectangular protrusion 16' and the guide slot 29' can provide more stability to confine the flat portions 13 of the guard plate 10 sliding within the appendages 20.

Note that the specifications relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A guard device for protecting the front panel of a smoke exhauster comprising:

a guard plate having a rectangular body of an arched front surface and a planar rear surface and flat portion at each of two ends thereof, said flat portion having a first hook member at an upper end including an arched surface joined with the arched front surface of said plate and a pair of fillets transversely extended along a rear side thereof;

a pair of securing appendages respectively fixed to lateral ends of said front panel each comprising a rectangular body, a roughly T-shaped protrudent portion having an arched surface connected to a lateral side and abutting the most forward surface of the rectangular body for defining a sliding space therebetween, a pair of transverse flanges extended rearward from two ends of the rectangular body, a fillet transversely extended on an upper portion of the forward surface thereof for snap fitting the pair of fillets of said guard plate and a second hook member projected inward from a transverse lower end of said T-shaped protrudent portion for suspending the first hook member of said guard plate therefrom;

whereby, said guard plate is held by said appendages and slides thereabout.

2. A guard device as recited in claim 1 wherein said guard plate further comprises a rectangular protrusion vertically extended along a center of rear side of the flat portions thereof and across the pair of transverse fillets.

3. A guard device as recited in claim 1 wherein said securing appendages further comprising a rectangular guide slot vertically extended along a center of the forward surface of the rectangular body thereof and across the transverse fillet.

4. A guard device as recited in claim 2 wherein said rectangular protrusion is beveled.

5. A guard device as recited in claim 3 wherein said rectangular guide slot is beveled.

* * * * *